US008701538B2

(12) United States Patent
Marscher et al.

(10) Patent No.: US 8,701,538 B2
(45) Date of Patent: Apr. 22, 2014

(54) SYSTEM FOR PROTECTION AGAINST MISSILES

(75) Inventors: William Donnelly Marscher, Morristown, NJ (US); William Joseph Kelly, Montville, NJ (US)

(73) Assignee: Mechanical Solutions, Inc., Whippany, NJ (US)

( * ) Notice: Subject to any disclaimer, the term of this patent is extended or adjusted under 35 U.S.C. 154(b) by 0 days.

(21) Appl. No.: 13/297,457

(22) Filed: Nov. 16, 2011

(65) Prior Publication Data

US 2012/0312149 A1 Dec. 13, 2012

Related U.S. Application Data

(63) Continuation-in-part of application No. 12/058,003, filed on Mar. 28, 2008.

(60) Provisional application No. 61/414,417, filed on Nov. 16, 2010, provisional application No. 60/908,806, filed on Mar. 29, 2007.

(51) Int. Cl.
*B64D 1/04* (2006.01)

(52) U.S. Cl.
USPC ..... 89/1.11; 89/1.14; 89/40.03; 89/41.13

(58) Field of Classification Search
USPC ..... 89/1.11, 1.41, 40.03, 41.13
See application file for complete search history.

(56) References Cited

U.S. PATENT DOCUMENTS

| | | | |
|---|---|---|---|
| 5,898,125 | A | 4/1999 | Mangolds et al. |
| 6,279,482 | B1 | 8/2001 | Smith et al. |
| 6,957,602 | B1 | 10/2005 | Koenig |
| 7,190,304 | B1 | 3/2007 | Carlson |
| 7,202,809 | B1 | 4/2007 | Schade et al. |
| 2004/0244628 | A1 | 12/2004 | O'Dwyer et al. |
| 2006/0097102 | A1 | 5/2006 | Chang |

FOREIGN PATENT DOCUMENTS

| | | | |
|---|---|---|---|
| EP | 0687885 | A1 | 12/1995 |
| FR | 2761182 | A1 | 9/1998 |
| WO | 2008/147592 | A2 | 12/2008 |

OTHER PUBLICATIONS

Internet Citation [Online] Defense Update: Active Protection Systems at AUSA 06. Report on AUSA Conference—Oct. 9-11, 2006. Retrieved from URL on Jun. 11, 2008: http://www.defense-update.com/events/2006/summary/ausa06aps.htm.

Internet Citation [Online] Raytheon Company: News Release on Raytheon's Quick Kill Achieves a First; Decimates 'Enemy' RPG in Test with Precision Launched Munition, Feb. 8, 2006. PRNewswire-FirstCall/. Retrieved from URL on Jun. 23, 2008: http://www.prnewswire.com/cgi-bin/micro_storie.pl?ACCT=14999&TICK=RTN&STORY=/www/story/02-08-2006/0004277736&EDATE=FEB+8,+2006.

(Continued)

*Primary Examiner* — J. Woodrow Eldred

(74) *Attorney, Agent, or Firm* — Merek, Blackmon & Voorhees, LLC

(57) ABSTRACT

Multiple embodiments of a system are disclosed for defeating enemy missiles and rockets by the use of a non-lethal cloud of pellets that collide with the missile a certain distance away from the target causing premature detonation of the missile, and/or possible severe damage to the missile, and/or deflection of the missile, and/or a deformation to the ogive cones to cause a short in the fuze circuit, and/or deposition of conductive material to cause a short in the fuze circuit.

13 Claims, 7 Drawing Sheets

(56) References Cited

OTHER PUBLICATIONS

Internet Citation [Online] Maj. Gen. Jeffrey A. Sorenson. Trophy Active Protection System for AFV's. Defense Online Magazine, update Newscast, Sep. 12, 2006. Retrieved from URL on Oct. 15, 2008: http://www.defense-update.com/events/2006/summary/ausa 06 aps.htm Israeli Weapons.com. Trophy Protection System for AFVs Images Retrieved from URL: http://www.israel-weapons.com/weapons/missile_system/systems/trophy/Trophy.html.

Internet Citation [Online] Israel Military Industries, Issue 1, 2006. Iron Fist Active Protection System (APS). Retrieved from URL Jun. 11, 2008: http://www.defense-update.com/products/i/iron-fist.htm.

Internet Citation [Online] BAE/United Defense: CICM Cose-In-Counter-Measures: DEF update 2004, Issue 1 Retrieved from URL Jun. 11, 2008: http://www.defense-update.com/products/c/CICM.htm.

Internet Citation [Online] BAE/IAAPS: US Army Active Defense Program. DEF update 2004, Issue 1 Retrieved from URL Jun. 11, 2008: http://www.defense-update.com/products/i/iaaps.htm.

Internet Citation [Online] Foster Miller: RPGNet Active Protection System from Qinetiq. Report on AUSA Conference—Oct. 9-11, 2006. Retrieved from URL Jun. 11, 2008: http://www.defense-update.com/products/r/rpgnet.htm.

Internet Citation [Online] Janes Information Group: Textron Systems Corporation Tactical Rocket Propelled Grenade Airbag Protection System (TRAPS) (United States), Published Aug. 1, 2008. Retrieved from URL on Nov. 8, 2008: http://www.janes.com/extracts/extract/jaau/jaaua 164.html.

Internet Citation [Online] Metal Storm: Redback Weapon System. Retrieved from Manufacturers' URL Nov. 10, 2008: http://www.metalstorm.com/content/view/38/98/.

International Search Report and Written Opinion issued by KIPO as ISA, for corresponding International Application No. PCT/US2008/058653 with mail date of May 30, 2011.

Department of Defense Directive, No. 3000.3, Jul. 9, 1996 (Certified Current as of Nov. 21, 2003); Policy for Non-Lethal Weapons.

International Search Report with Written Opinion for corresponding International Application No. EP11009098, with mail date of Feb. 26, 2013.

SYSTEM FOR PROTECTION AGAINST MISSILES

CROSS-REFERENCE TO RELATED APPLICATIONS

This application (1) is a continuation-in-part of U.S. application Ser. No. 12/058,003, filed Mar. 28, 2008, which claims the benefit of U.S. Application 60/908,806, filed Mar. 29, 2007, and (2) claims the benefit of U.S. Application 61/414,417, filed Nov. 16, 2010, the contents of each of which are incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of contract No. N00014-06-C-0040 awarded by the Office of Naval Research.

FIELD OF THE INVENTION

The present invention relates to a system for defeating enemy missiles and rockets generally, and more particularly to a system of generating a non-lethal cloud of projectiles or pellets intended to collide with an enemy missile to cause premature detonation of the missile, and/or possible severe damage to the missile, and/or deflection of the missile, due to the relatively high velocity of the missile.

BACKGROUND

During the times of terrorism and war, various guided and unguided missiles have been used resulting in casualties. A system that protects structures, ground/air/sea vehicles, and the people inside them against missile attack could save the lives of military troops as well as civilians. A common unguided missile currently used is the rocket-propelled-grenade (RPG). RPGs can come in both a single and tandem warhead form. The tandem warhead has two or more stages of detonation, namely a first stage detonation designed to trigger a reactive defense and a second stage detonation designed to attack the same location as the first stage detonation location. Tandem warheads generally are much larger and more lethal than single warheads, making predetonation alone a less attractive defense strategy. Also due to different fuzing methods at the different stages, short circuiting via impact of tandem warheads may not be achievable.

Existing technologies for RPG or missile defeat systems include application of slat armor to the military vehicles. The principle of slat armor is to stop the missile before it strikes the body of the target, to crush the missile and short circuit its electric fuze, or to cause shaped charge detonation at a standoff distance, rather than directly on the body of the vehicle. Disadvantages to slat armor are that it adds significant weight to the vehicle, and sacrifices maneuverability. The standoff distance it provides in case of predetonation is too short to be of significant benefit. Other RPG or missile defeat systems launch a single or small number of projectiles toward the incoming missile. These systems require accurate sensing of the missile trajectory, accurate aim of the projectiles in order to intercept the missile, and fast reaction time to slew and fire the projectile.

Another existing strategy for RPG defeat is to deploy a commercial air bag to trap and/or crush the RPG before it strikes the vehicle. Still another is to deploy a net-shaped trap made of super high strength ballistic fiber. Both the bag and the net are claimed to defeat the RPG by crushing its ogive and rendering the fuze inoperable. Both the airbag and the net intercept the RPG at a standoff distance of up to two meters. At this standoff distance, the RPG shaped charge jet still has significant penetrating ability. Neither of these competing technologies prevents the detonation of the RPG by its built-in self-destruct mechanism, nor do they protect nearby personnel from shrapnel from the exploding RPG.

SUMMARY

A system is disclosed for defeating enemy missiles and rockets, particularly rocket propelled grenades (RPG's). The first step is to identify the firing of a missile by the use of sensors that give the approximate distance and bearing of the incoming missile. A non-lethal cloud of projectiles or pellets is then launched from the target, which can be a building or vehicle or the like, in the general direction of the missile. The pellets are housed in a series of warhead containers mounted at locations on the target in various orientations. The warheads are triggered to fire a low velocity cloud of pellets toward the incoming missile. The pellets then collide with the missile a certain distance away from the target causing an electrical short in the missile's fuze circuit, and/or premature detonation of the missile (including possible disruption of the shaped charge pellets of the early formation of the shaped charge jet), and/or possible severe damage to the missile, and/or deflection of the missile (particularly the warhead shaped charge liner), due to the relatively high velocity of the missile.

In a preferred embodiment of the present disclosure, the system does not require highly accurate sensing of the incoming missile location, nor does it require slewing of a countermeasure weapon. This leads to increased potential for interception of missiles fired from very close range. The shot can be fired at non-lethal velocities, since the missile velocity will provide nearly all of the required impact energy. The present system preferably contains no high explosives or fuzes, which will lead to ease of transportability and implementation. Also, the system is preferably not lethal to people standing in the path of the shot when fired. As used herein, the concept of non-lethality is generally understood to one skilled in the art in the relevant field with reference to the US Department of Defense Directive 3000.3, which defines non-lethal weapons as weapons that are explicitly designed and primarily employed so as to incapacitate personnel or materiel, while minimizing fatalities, permanent injury to personnel, and undesired damage to property and the environment, and that are intended to have relatively reversible effects on personnel or materiel and/or affect objects differently within their area of influence. As also set forth in the US Department of Defense Directive 3000.3, non-lethal weapons shall generally not be required to have a zero probability of producing fatalities or permanent injuries, but when properly employed, should significantly reduce the probability of producing the same. There are several possible outcomes of the interaction between nonlethal pellets or projectiles with an RPG, namely a neutralization of the RPG where a short is generated in the RPG fuze circuit, or the RPG shaped charge liner gets damaged thereby degrading its lethality, or a predetonation of the RPG, or a combination of a damaged liner and a predetonation. All four outcomes are beneficial in that they reduce the resulting damage and loss of life caused by the RPG. Another aspect of predetonated RPGs is that appropriate density shot has also been demonstrated to limit the travel of shrapnel from the point of RPG detonation. The shot cloud system is relatively lightweight and easy to deploy.

DETAILED DESCRIPTION OF THE PREFERRED EMBODIMENTS

Figure 1:
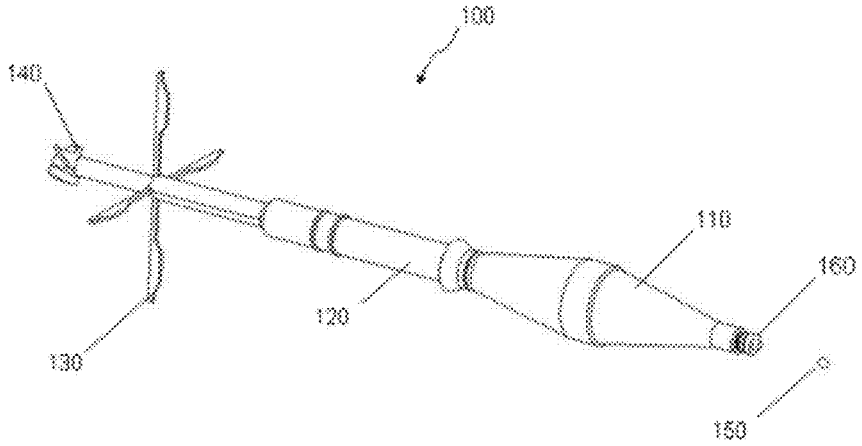
FIG. 1 illustrates one embodiment of a typical RPG.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 illustrates one embodiment of a typical rocket-propelled grenade (RPG) 100 comprising an ogive 110, a sustainer motor 120, stabilizer fins 130, a rear offset fin 140 and a fuze 160. While an RPG is illustrated, it will be appreciated that the protective system of the present invention could be employed on any incoming enemy threat such as a missile, rocket, or the like. For purposes of convenience, the enemy threat will be described simply as an RPG.

The firing of the RPG 100 can be detected by various sensing means (not shown) including infrared (IR) sensors, radar and/or cameras. These sensors can be mounted on the potential target structure, which can be a vehicle or building, for determining approximate distance and bearing of the incoming RPG. Alternatively, sensors can be mounted separate from the target structure but in close proximity to the target structure if necessary. Alternatively, offsite or remote sensors could be utilized instead of, or in addition to onsite sensors, to improve the accuracy and/or tracking of the protective system of the present invention. Various sensor means could be employed as desired by the user and in accordance with appropriate field conditions.

Sensors are used to trigger warhead devices (described in more detail below) mounted on a target or an adjacent location to produce a cloud or screen of projectiles or pellets (see FIG. 8) intended to engage and disable an incoming RPG. More preferably, a variety of warhead devices are mounted in strategic locations relative to the target so that the target is sufficiently protected through a surrounding screen of pellets that will allow up to the entire target structure to be protected. The warhead can be any device or combination of devices that will propel shot in a manner that will produce a cloud or screen of relatively low velocity pellets 820 (see FIG. 8) distributed such that they have a significant probability of hitting an incoming RPG.

In one non-limiting example, warhead containers (to be described below) with tubular cross-sections of 40 mm to 100 mm were tested, although other dimensions will be operable. The tubes were filled to various depths with projectiles or pellets, which were discharged at varying velocities. The pellets were discharged with and without the aid of a pusher plate (to be described below). The shot dispersion angle at the muzzle of the tubes was measured using a high speed camera. Results of this testing are shown in Table 1.

TABLE 1

Dispersion Testing

| Tube Diameter, mm | Velocity, ft/s | Depth, in. | Pusher Plate | Dispersion Angle |
|---|---|---|---|---|
| 40 | 60 | 3 | No | 38° |
| 40 | 80 | 6 | No | 37° |
| 40 | 60 | 12 | No | 31° |
| 40 | 75 | 3 | Yes | 34° |
| 40 | 95 | 6 | Yes | 34° |
| 40 | 100 | 12 | Yes | 24° |
| 100 | 60 | 2 | No | 45° |
| 100 | 90 | 4 | No | 59° |
| 100 | 55 | 2 | Yes | 45° |
| 100 | 65 | 4 | Yes | 53° |

Statistical calculations revealed that a dispersion angle of 30° or more resulted in a shot pattern that provides a high probability of impact with an incoming RPG. The use of a pusher plate resulted in a more even dispersion pattern, although other methods to achieve this are possible. Warhead shot containers with rectangular or elliptical cross-sections may also be used. Other cross-sectional configurations are contemplated. A wide range of organic and inorganic materials, including, but not limited to, reinforced plastic, polymeric composites, aluminum and steel, can be used for the shot containers. Other materials are contemplated.

Figure 2:
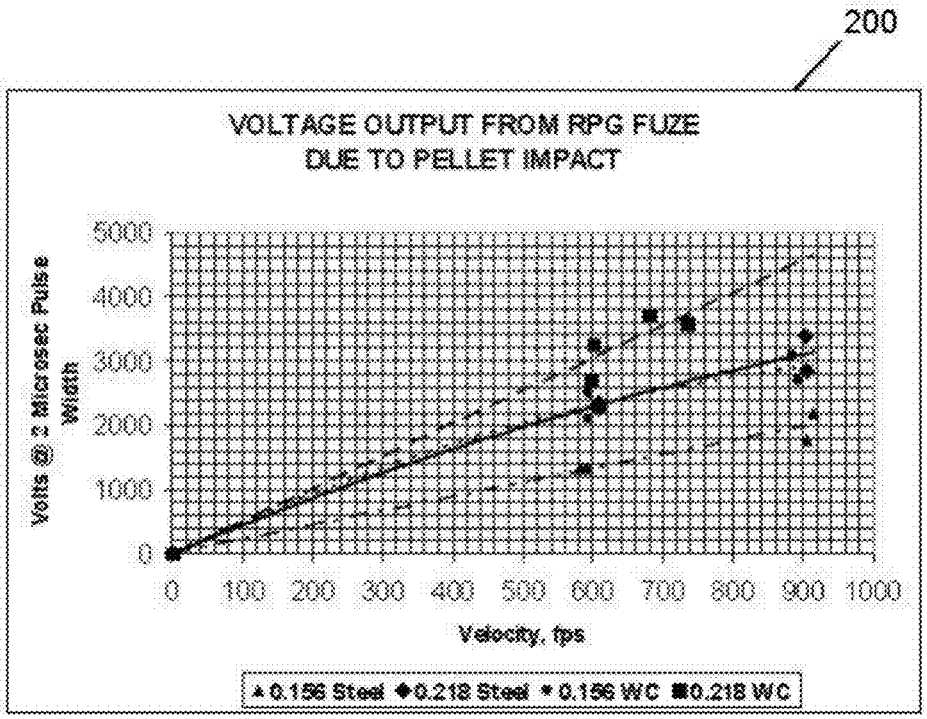
FIG. 2 illustrates voltage output from RPG fuze due to pellet impact.

A significant amount of testing was performed, using the RPG of FIG. 1, to establish a preferred size, shape, and material of the shot. Pellets 150 of various materials and structural compositions were fired in the laboratory at inert RPG grenades with piezoelectric fuzes 160, and fuze output voltages were measured. It was determined that suitably dimensioned pellets with a range of shapes, compositions and sizes or combinations thereof can be used to pre-detonate the RPG and conversely certain materials and/or shapes can be used to enhance probability of ogive penetration, but diminish the probability of predetonation. FIG. 2 (200) shows that both steel and tungsten carbide shot, preferably greater than 0.156 inch diameter, produced sufficient fuze output voltage and generated a sufficient voltage pulse in the RPG detonation fuze to pre-detonate an RPG if the impact was on the RPG fuze. Other shot materials evaluated include reactive particles, piezoelectric particles and triboelectric particles, where in one embodiment for example, the shot material is ejected to impart an electric charge to the body of the incoming threat so that its detonator prematurely activates. These particles react on impact with the RPG to defeat it by one of the mechanisms described above. In the embodiment of FIGS. 1 and 2, a solid pellet formed from a single or homogeneous material is disclosed. However, as will be discussed in connection with the embodiment of FIGS. 9A and 9B, the pellet may comprise more than one material, and can comprise a plurality of materials if desired. Other material compositions are also contemplated.

Figure 3:
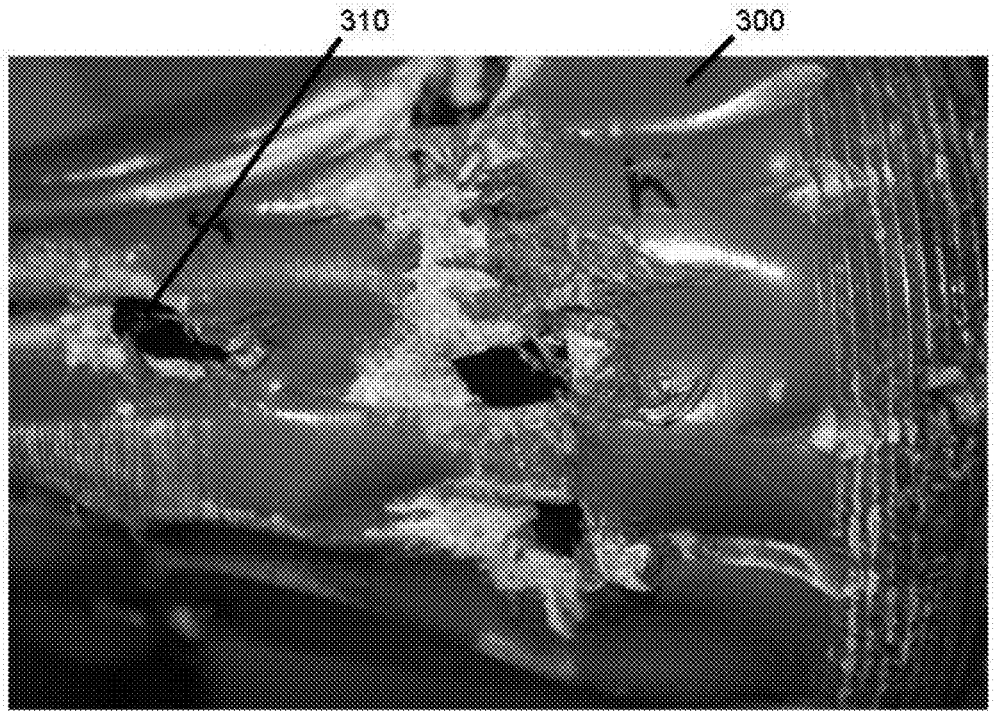
FIG. 3 illustrates a RPG ogive that has been damaged by the protective system of the invention.

As shown in FIG. 3, an RPG ogive 300 can be significantly damaged by impact with the pellets. Both steel and tungsten carbide pellets were found to dent or penetrate 310 the ogive 300, with other materials anticipated to have similar results. Pellets that penetrate the ogive can produce an electrical short between the inner and outer ogives, turning the RPG into a "dud" by circumventing the action of its piezoelectric fuze circuit. Ogive penetration 310 also can disrupt the shaped charge and reduce its lethal penetrating ability. An observation during testing was that pellet impacts also have the potential for deflecting a RPG off course. A significant amount of testing was performed on the RPG of FIG. 1 to establish an ideal configuration of projectile that causes ogive and shaped charge liner damage. A cube-shaped steel projectile 910 (FIG. 9A) of approximate ⅜ inch size was found to reliably penetrate an RPG ogive over the expected relative velocity range. The sharp edges of the cube-shaped projectile 910 enhance the penetrating capability. It was further determined through testing that the cube shape was insensitive to orientation, and that tumbling of the cube in flight should not prevent ogive penetration.

Figures 9A, 9B:
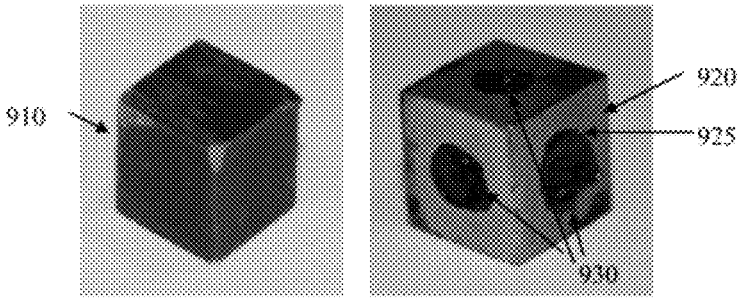
FIG. 9A illustrates one embodiment of a cube-shaped projectile and FIG. 9B illustrates one embodiment of a cube-shaped, electrolyte-packed projectile for use in neutralizing an RPG or damaging the shaped charge liner of an RPG.
Figure 10:
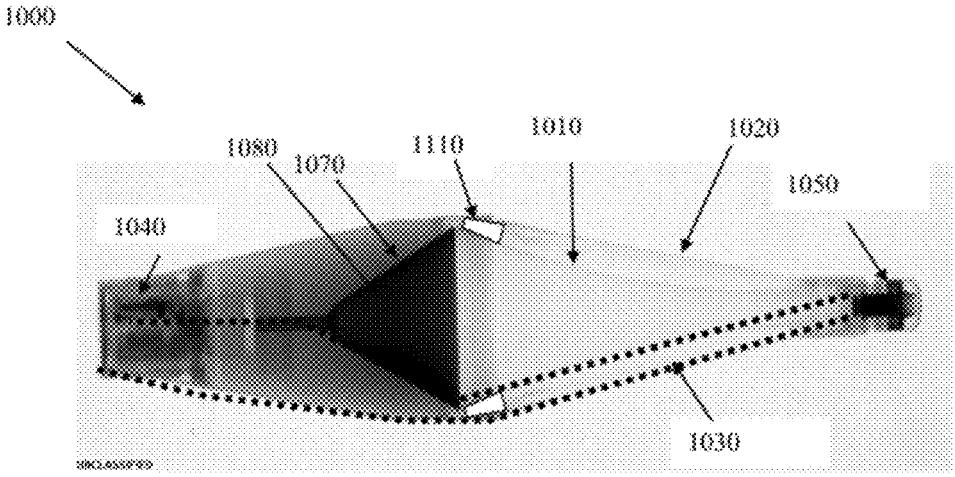
FIG. 10 illustrates one embodiment of a RPG fuze circuit and a diagrammatic view of a short circuiting mechanism of the electrolyte-packed projectile implementation.
Figure 11:
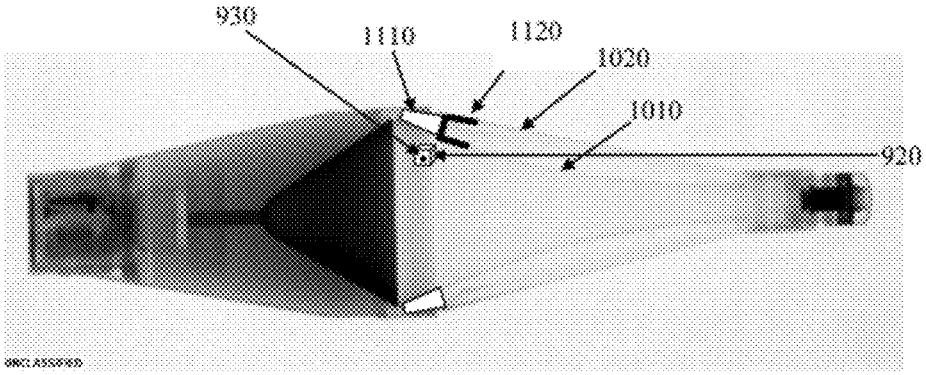
FIG. 11 illustrates one embodiment of a mechanism of dudding an RPG fuze circuit by deposition of an electrolytic substance.

FIG. 10 illustrates one embodiment of an RPG ogive 1000 including an inner cone 1010 and an outer cone 1020 and an insulator surface 1110 defined therebetween, an electric detonation circuit 1030 defined between a detonator 1040 and a trigger or fuse 1050, and a shaped charge liner 1070 that lines a shape charge 1080. Ogive dents and/or penetrations 310 (FIG. 3) can cause short circuiting of the electric detonation circuit 1030, thereby causing the shaped charge 1080 not to actuate upon impact with the target (not shown). The inner cone 1010 and outer cone 1020 are part of the electric circuit 1030 and must be remain insulated (1110) from each other. Collapsing the cones 1010 and 1020 together, or directly shorting them together with a conductive projectile that embeds in both cones 1010 and 1020, can therefore short the fuze 1050 and neutralize the operation of the shape charge 1080. However, in the event that either direct shorting with a conductive solid projectile or that collapse of the ogive 1000, in and of itself, is insufficient to reliably cause sufficient conduction between the inner and outer cones 1010 and 1020 of the ogive 1000, a hollow projectile 920 (FIG. 9B) including a conductive substance 930 may be used to deliver the conducting substance 930 in between the cones 1010 and 1020, which substance 930 coats the insulator 1110 thereby shorting the fuze circuit 1030. As shown in FIG. 9B, the conducting substance 930 may be packed into one or more holes 925 through one or more sides of the cube shaped projectile 920. As shown in FIG. 11, upon penetration of the ogive 1000 by the cube 920, the cube 920 releases the substance 930, some portion of which coats (1120) the insulator 1110 and shorts the fuze circuit.

Figure 4A:
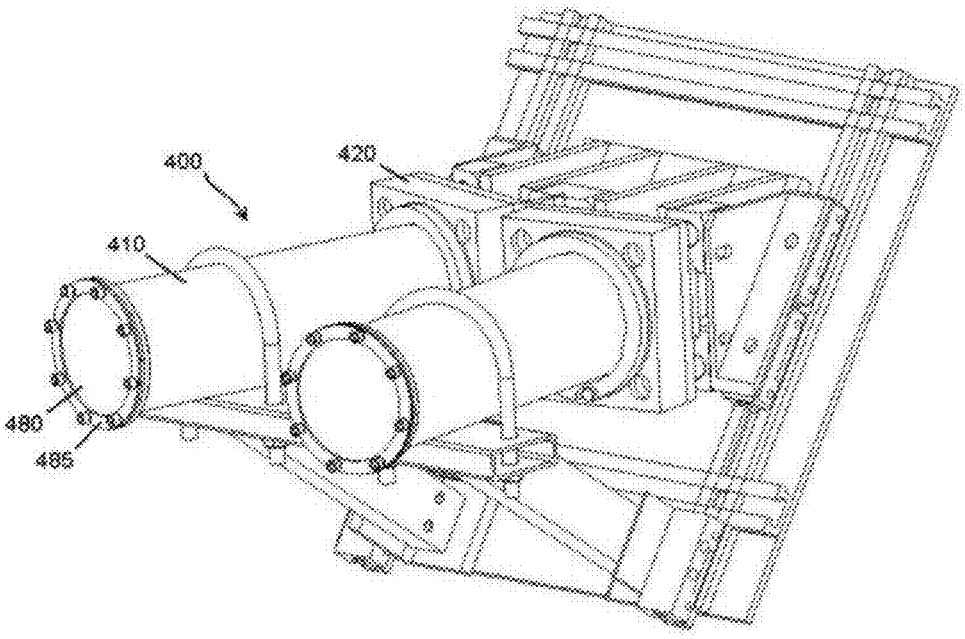
FIG. 4A illustrates one embodiment of a pair of warheads for implementing the system of the present invention.

FIG. 4A illustrates a non-limiting embodiment of a pair of warhead shot containers 400 comprised of steel cylindrical tubes 410 mounted at its back ends 415 on bases 420 preferably having, as tested, an inside diameter of approximately 100 mm, a length of approximately 14 inches, and wall thickness of approximately 0.1 inches. Other measurements and dimensions are possible. While two containers are shown, it will be understood that only one container may be utilized, or more than two as the need or situation arises. Furthermore, while the containers are oriented in a consistent relationship, it will be understood that the other orientations are possible as long as there is no detrimental cross-fire.

Figure 4B:
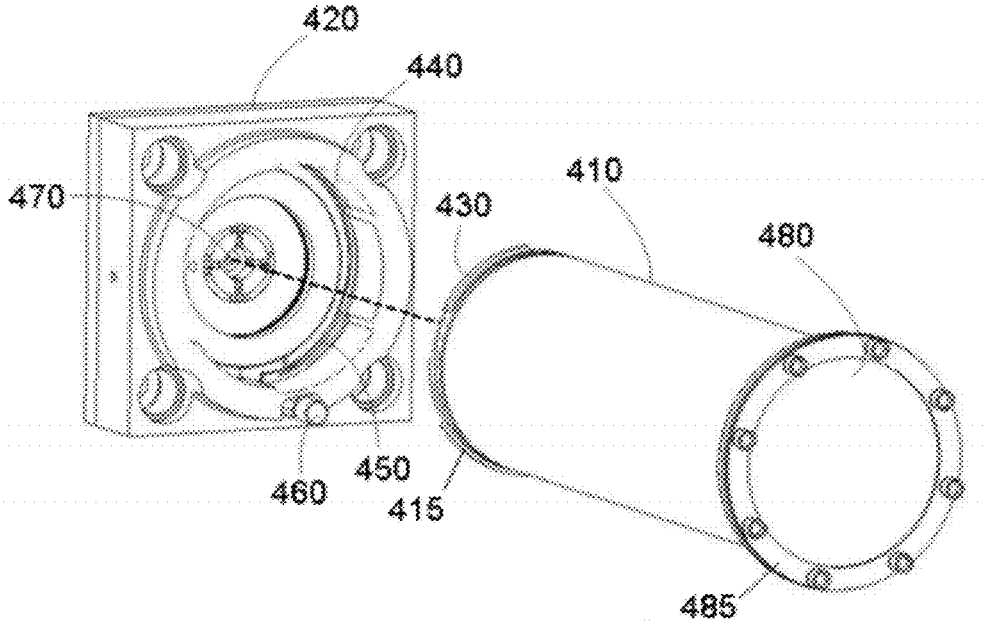
FIG. 4B illustrates one embodiment of a warhead of the invention attachable to a base.

As shown in FIG. 4B, a tube 410 is mounted at its back end 415 to a base 420 through the engagement of locking tabs 430 on the tube 410 with locking slots 440 on the base 420. A wave spring 450 is further provided on the base for biased contact between the tube 410 and base 420, while a locking pin 460 provides additional secured engagement at the junction of the tube 410 and base 420. A contact socket 470 in the base 420 allows for passage of the actuation mechanism that activates the warhead 400.

Figure 5:
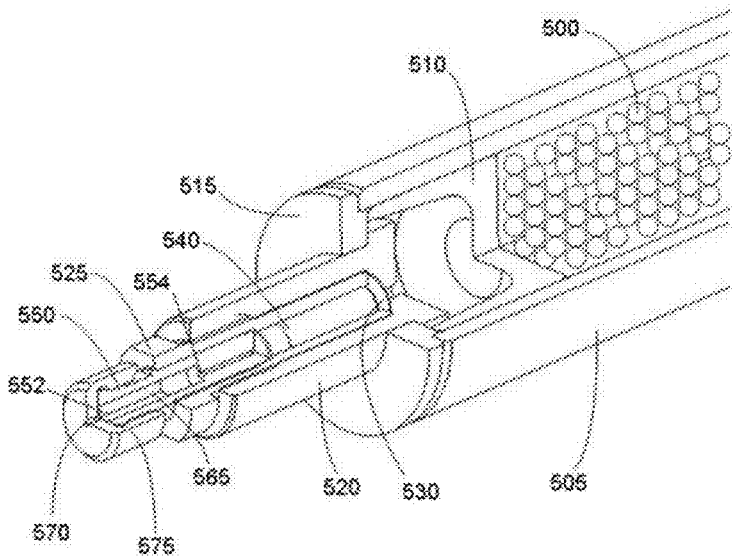
FIG. 5 illustrates one embodiment of a section of a canister of the present invention.

One embodiment of a proven design of a propulsion system at the back end 415 of a warhead 400 is shown in FIG. 5. The warheads 400 house pellets 500, such as projectiles 910 or 920 of FIGS. 9A and 9B respectively, for example, and a pusher cup or plate 510. The pellets 500 are held in the warhead 400 preferably by a frangible or dislodgeable cover 480 (FIGS. 4A, 4B) secured, for example, by a plastic ring 485. Behind the pusher plate 510 is a cylindrical pressure chamber which will propel the pusher plate 510 and pellets 500 when sufficient pressure occurs. A high-low adapter 520 and a canister base 515 are welded to the preferably 100 mm canister 505. A high pressure 12-gauge insert 525, with a brass burst disk 530 in front of it, is threaded into the high-low adapter 520. A pyrotechnic mechanism such as a 12-gauge shotgun shell 540 with a pre-wired primer is inserted into the high pressure insert 525. A threaded rod 550, with a large axial hole 552 at the back and a small axial hole 554 at the front, is screwed into the high pressure insert 525 behind the shotgun shell 540. Primer wires 560 are threaded through the axial holes 552, 554 and attach to the shot gun shell 540. A grooved rubber plug 565 is inserted into the large axial hole 552, with the wires 560 in the groove. The wires 560 are threaded through the hole 570 in the threaded cap 575, which is then screwed onto the threaded rod 550. When electronically triggered, the propellant will ignite and will launch the pusher cup 510 and shot 500. This propulsion system was employed and performed successfully during live RPG testing. Other propulsion systems are possible, such as sheet explosives, which have the potential for warhead size and weight reduction.

Figure 6:
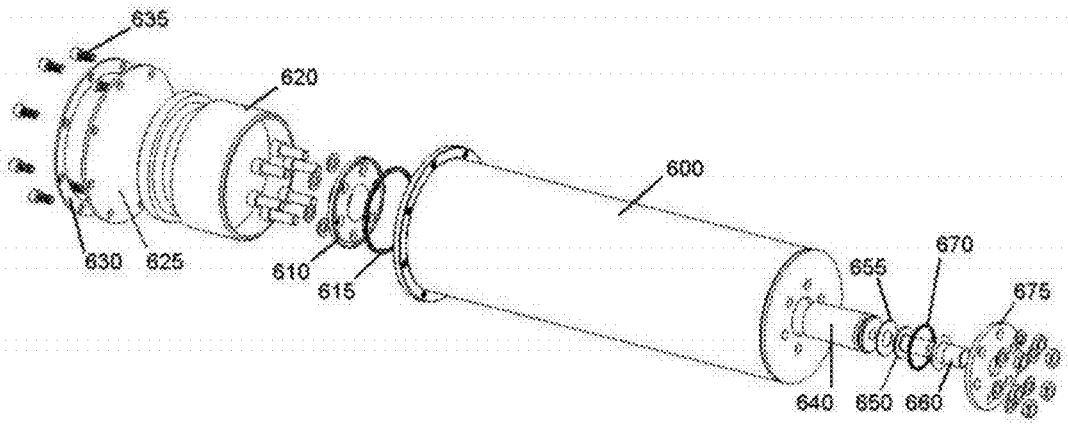
FIG. 6 illustrates one embodiment of a warhead assembly of the present invention.

Another embodiment of the proven design of a propulsion system useful in the present invention is shown in the warhead tube 600 of FIG. 6. A cartridge holder 610 and an O-ring seal 615 are bolted, with lock washers, on the inside of the warhead tube 600. A pusher plate 620 and pellets (not shown) are then placed in the tube 600 and held there by a frangible cap 625, secured to the tube 600 by a steel washer 630 and cap screws 635. A 20 mm cartridge 640 with an electric primer 645 and containing propellant (not shown) is inserted into the cartridge holder 610 at the back of the warhead and a metal contact bar 650, rubber washers 655, a plastic insulating sleeve 660, an O-ring 670 and a support plate 675 are attached. The metal contact bar 655 contacts the center of the primer in the cartridge 640. Rubber and plastic components insulate the contact bar 650 from the rest of the assembled warhead tube 600.

Another embodiment of a propulsion system useful in the present invention involves using a pneumatic assembly at the back of the warhead tube 600 comprising a pressurized cartridge and a fast acting release valve, wherein such propulsion system utilizes compressed air to propel the pellets or projectiles.

Figure 7:
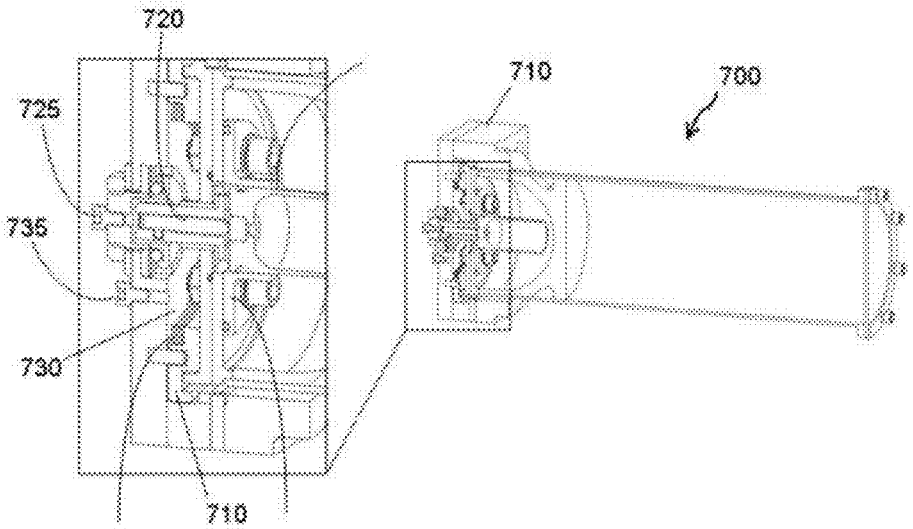
FIG. 7 illustrates one embodiment of electrical connections useful for operating the system of the present invention.

In accordance with one embodiment of the present invention, two warheads 700 (only one being shown; see FIG. 4A that shows two) are then inserted into breech blocks 710 with electrical contacts as shown in FIG. 7. Specifically, the metal contact bar 720 on the warhead 700 contacts the positive electronic firing pin 725 in the breech block 710. The metal support ring 730 on the warhead 700 contacts the negative firing pin 735. When electronically triggered, the propellant will ignite and will launch the pusher cup and pellets or projectiles.

In a preferred, non-limiting embodiment, for the RPG ogive identified in FIG. 3, for example, each warhead is filled with solid, spherical pellets made of tungsten carbide having a diameter of approximately 0.215 inches, a density of approximately 14.9 g/cm$^3$, and a Rockwell C hardness of approximately 75 (predetonation pellets). This configuration results in approximately 15,000 pellets housed in each warhead. Other shot configurations are contemplated. When triggered, the pellets are ejected from the two warheads in a non-precise manner and typically radiate as clouds or screens (see FIG. 8) with expanding circular cross-sections that progressively overlap. The pellets leave the warheads at speeds between 50 ft/s and 150 ft/s, and more preferably at speeds that are non-lethal to nearby personnel. In this example implementation, the pellets will have a dispersion angle of approximately 40 degrees radiating from each warhead tube, and an overall dispersion angle from a pair of warhead tubes of approximately 60 degrees. Other dispersion angles are contemplated. This configuration using a large number of pellets will result in a high probability of encountering the piezoelectric device on the nose of the missile ogive, and thereby causing premature detonation of the missile. This was confirmed by testing one described typical embodiment system against several separate live RPGs fired from an RPG launcher. The RPGs that entered the protected area of the screen all detonated upon impact with the pellets.

In a further embodiment, each warhead is filled with approximately 1300 steel solid cubes 910 (FIG. 9A) having a side length of approximately ⅜ inch. Other cube dimensions are possible. The goal is to cause an impact between a cube 910 and the ogive 1000 (FIG. 10) and damage the shaped charge liner 1070 of the RPG ogive 1000. These cubes 910 are dispersed in a screen or cloud (see FIG. 8) that is less dense than would be obtained with the 15,000 spherical pellets used for predetonation purposes as described above. Too dense of a screen would cause high probability of nose fuze 1050 impacts and predetonation. In a further embodiment, a second warhead is released at a slight time delay (20 to 50 msec, for example) from the first warhead in order to increase the probability of impacting the ogive 1000 with a cube 910. The second screen created by the second warhead release will preferably damage RPGs that pass through the first screen without impact.

In a further embodiment, a first warhead is filled with solid cubes 910 (FIG. 9A) for creating a first projectile screen and a second warhead is filled with predetonation pellets for creating a second pellet screen. The second warhead is delayed from the first warhead so that the first projectile screen can damage the shaped charge liner 1070 and the second pellet screen causes predetonation of the damaged warhead. This strategy is preferable for defense against tandem RPG warheads (not shown) which present difficulties for other dudding strategies.

In a further embodiment, two warheads are each filled with approximately 1300, ⅜ inch size cubes 920 (FIG. 9B) with holes 925 of approximately 5/32 inches in diameter placed through the center of each side. The holes 925 in the cube 920 are filled with electrically conductive substance 930. The goal is to cause an impact between cube 920 and the ogive 1000 and release the substance 930 between the cones 1010 and 1020 across the insulator surface 1110 to short the fuze circuit 1130 (see FIGS. 10 and 11). These cubes 920 are preferably dispersed in a screen or cloud that is less dense than would be obtained with pellets used for predetonation purposes. Too dense of a screen would cause high probability of nose fuze 1050 (FIG. 10) impacts and predetonation. A second warhead may be used to release a second projectile screen at a slight time delay (20 to 50 msec, for example) from a first warhead used to release a first projectile screen in order to increase the probability of impacting the ogive 1000 with a cube 920. RPGs that pass through the first projectile screen without impact will therefore have a second opportunity to be damaged by the second projectile screen. In one embodiment the electrically conductive substance 930 can be comprised of various types of electrically conductive grease or gel. Common commercially available greases are available which include, but are not limited to, carbon, silver, copper or aluminum particles to provide conductivity. Other possible materials include, but are not limited to salt water-based conductive gels or electrolytes that are commonly used in biomedical applications such as for electrocardiogram electrodes. The viscosity of the gel and grease ensures dispersion from inside the cube 920 or other carrier projectile and encourages adherence onto the surfaces of the ogive cones and insulator 1120. However, embodiments may also employ conductive powders and low viscosity liquids, although timely dispersion and post-dispersion adherence to the ogive surfaces is important. Electrical volume resistivity less than 30 ohm-cm is preferable of the conductive substance 930.

Figure 8:
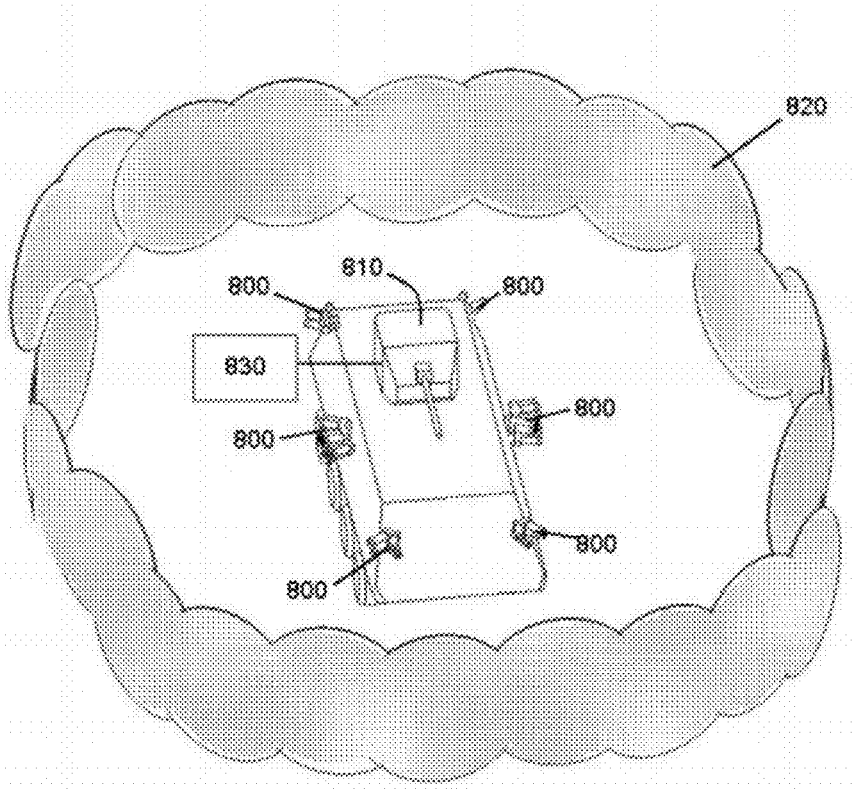
FIG. 8 illustrates clouds of pellets surrounding a target.

As shown in FIG. 8, a series of warheads 800 can be mounted on a vehicle 810 and can protect the vehicle 810 from missile attack. Any structure can be provided with complete coverage by proper placement and orientation of a series of warhead tubes. In the typical embodiment, the shot screen 820 is fired in order to strike the missile 10 to 20 feet from the target vehicle or building. While the screen 820 is shown to form a single perimeter around the vehicle 810, it will be appreciated that multiple temporally-spaced waves (not shown) of screens may be utilized, particularly when it is desired to counter tandem RPGs and the like. Once the sensor 830 detects that a missile has been fired, the speed and approximate trajectory of the missile must also be determined by measurement, typically supported by rapid calculation. Calculations are made to determine if, when and approximately where the missile will strike the vehicle or building, therefore determining which warhead tubes must be fired, and when they need to be fired. This will require a distributed or central processing unit (not shown) that is capable of collecting data from the sensors and making the appropriate calculations. It should be noted that, in the preferred embodiment, the warhead tubes are mounted statically and are not slewed. The result is an automatic system capable of defeating multiple missiles and thereby protecting vehicles, buildings, and people.

The shot is preferably fired at non-lethal velocities, since the missile velocity will provide nearly all of the required impact energy. In addition, one possible embodiment coats the penetrating projectile with a cushioning material or outer layer that would discourage rapid imparting of momentum to the RPG fuze, and would minimize harm to humans in its path. In such an embodiment, the much higher velocity of the missile ogive would shatter or rub through the protective layer, exposing the missile ogive to the projectile's penetrating surface. The present system preferably contains no high explosives or fuzes, which will lead to ease of transportability and implementation. Also, the system is preferably not lethal to people standing in the path of the shot when fired. The shot cloud system is relatively lightweight and easy to deploy. The result of the system for certain implementations is that the incoming missile will either have its fuze electrically shorted through the use of the projectile structure or a conductive substance or both and/or shaped charge damaged, or will detonate prematurely with large standoff distance before hitting its target and greatly reduce the resulting damage and loss of life.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

We claim:

1. A system for protecting a target against an incoming threat, comprising:

a. at least one container comprising a plurality of projectiles incorporating a conductive substance; and b. a propulsion system that ejects the plurality of projectiles from the at least one container;

c. wherein the plurality of projectiles are ejected in the form of a distributed cloud to intercept the incoming threat for purposes of releasing the conductive substance into the incoming threat and disabling the incoming threat prior to impact with the target;

d. wherein the plurality of projectiles are ejected at a velocity that is intended to be not lethal to nearby personnel; and e. wherein the conductive substance further comprises one of electrically conductive grease, conductive gel, conductive power or an electrolyte medium.

2. The system of claim 1, wherein the plurality of projectiles penetrates an outer surface of the incoming threat and delivers the conductive material into the incoming threat for purposes of short circuiting a detonation circuit in the incoming threat to render ineffective the incoming threat.

3. The system of claim 2, further comprising a plurality of containers mounted on the target for creating multiple clouds of ejected projectiles that are temporally spaced.

4. The system of claim 1, wherein the projectiles are cubes.

5. The system of claim 4, wherein the projectiles are formed from materials including at least one of steel, tungsten carbide, tungsten alloys, reactive particles, piezoelectric particles or triboelectric particles.

6. The system of claim 1, wherein the velocity is between 50 ft/sec and 150 ft/sec.

7. The system of claim 6, wherein the plurality of projectiles are ejected with a dispersion angle of at least around 30 degrees.

8. A method of disabling an incoming threat having a detonation circuit comprising impacting the incoming threat in a non-precise manner with a cloud of projectiles, a plurality of projectiles of the cloud having a conductive substance that is released from the projectile after impact of the projectile with the incoming threat and results in a short in the detonation circuit.

9. The method of claim 8, wherein the plurality of projectiles impact the incoming threat at a velocity of between 50 ft/sec and 150 ft/sec.

10. The method of claim 9, wherein the conductive substance further comprises one of electrically conductive grease, conductive gel, conductive powder or an electrolyte medium.

11. The method of claim 10, wherein the plurality of projectiles are formed from one of steel, tungsten carbide, or tungsten alloy pellets or reactive particles.

12. The method of claim 11, wherein the projectiles are cubes.

13. The method of claim 12, wherein the projectiles includes openings in which resides the conductive substance.

* * * * *